US005388379A

United States Patent [19]

Lamberti

[11] Patent Number: 5,388,379

[45] Date of Patent: Feb. 14, 1995

[54] ROOF EDGE COVERING

[76] Inventor: Erhard Lamberti, Redtenbacherstrasse 11, D-6900 Heidelberg, Germany

[21] Appl. No.: 923,791

[22] PCT Filed: Dec. 12, 1990

[86] PCT No.: PCT/DE90/00958

§ 371 Date: Aug. 27, 1992

§ 102(e) Date: Aug. 27, 1992

[87] PCT Pub. No.: WO91/10025

PCT Pub. Date: Jul. 11, 1991

[30] Foreign Application Priority Data

Dec. 27, 1989 [DE] Germany ..... 3943087

[51] Int. Cl.[6] ..... E04F 19/02

[52] U.S. Cl. ..... 52/300; 52/96; 52/468

[58] Field of Search ..... 52/58, 60, 94, 96, 97, 52/300, 468

[56] References Cited

U.S. PATENT DOCUMENTS 3,735,540 5/1973 Thaler ..... 52/94

3,969,850 7/1976 Hirai ..... 52/97

FOREIGN PATENT DOCUMENTS 315232 5/1989 European Pat. Off. .

1535284 8/1968 France .

2161565 7/1973 France .

3002198 7/1981 Germany .

*Primary Examiner*—Michael Safavi

*Attorney, Agent, or Firm*—Bell, Seltzer, Park & Gibson

[57] ABSTRACT

The invention relates to a covering for the raised surrounding edge of a roof having holders (1) and covering profiles (11), in which single-piece, angle-shaped holders (1) possess flat surfaces (5, 6) on their shanks (3, 4), which externally grip in dose contact over the end borders (9, 10) of the covering profiles (11) and hold the profiles firmly in position against the raised roof edge. The covering for the raised surrounding edge of a roof is extremely simple to assemble because, after mounting and adjustment of the holder (1), the end of the covering profile (11) is simply pushed in behind the flat surfaces of the shanks of the holder (1), eliminating any need for extra work of fastening the profile (11) to the border of the roof.

4 Claims, 2 Drawing Sheets

Fig. 1.
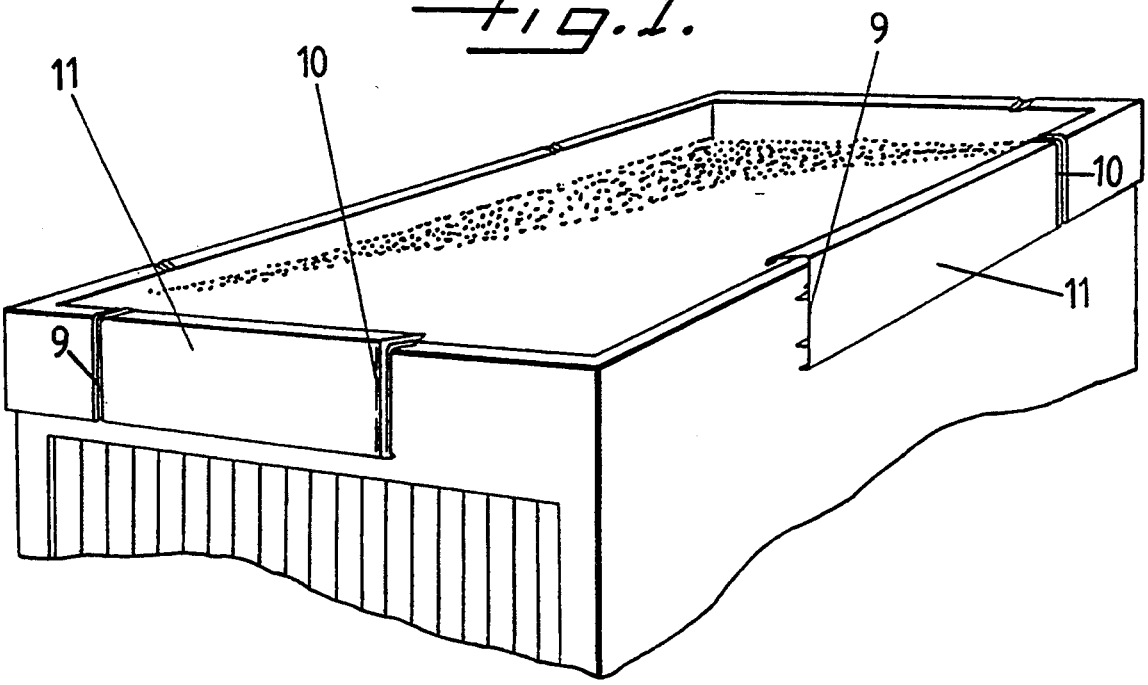
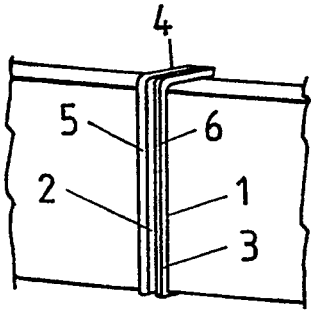
Fig. 1A.
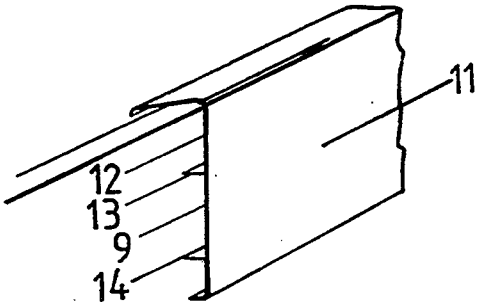
Fig. 1B.

ROOF EDGE COVERING

The present invention relates to a coveting for the raised surrounding edge of roof.

A covering of this type for the raised surrounding edge of a roof is already known from the Prospectus "GIEBELER-Flachdachabschluss Typ G-FA" of the Company Giebeler KG in Wiesbaden, in which holders fastened to ,the raised surrounding edge of the roof are provided for holding the covering profiles apart from each Other by means of holder angles, said holders having shanks disposed at an acute angle in relation to each other to form a U-shaped cross-section. The free ends of the flanges of the U-shaped cross shanks serve as support surfaces for the covering profile and the web of the cross-section serves as the fastening base for fastening screws which engage in the holder angles. The covering profiles are pushed into the holders. However, the erection and the assembling of this covering for the raised surrounding .edge of a roof is accompanied by a relatively great expenditure of effort.

The present invention is therefore based upon the problem of designing a covering of the type under discussion for the raised surrounding edge of a roof in such a way that it is especially easy to fabricate, may be readily assembled and, if the need should arise, may be just as readily disassembled.

The solution to this problem is based upon the fact that the holders are constructed in one piece, have a hat-shaped cross-section, engage in the vertical joints between the ends of the covering profiles by means of the inwardly-directed recesses for accommodation of the fastening means and cover over the outsides of the ends of the covering profiles by means of their projecting flanges. Under these conditions, the covering profiles are provided on the inner side of their vertical webs with spacer profiles which bear against the outside surface of the wall of the building.

Additional holding devices, with holder angles and the like, can be dispensed with. The ends of the covering-profiles are overlapped on the outside by the projecting flanges of the holder and are thus held firmly in position. The application of the covering for the raised surrounding edge of a roof is conceptually simple and guarantees an exactly aligned assembly by less-skilled workers without having to call upon technical experts, for the reason that the formerly-required complicated assembling of holder angles, holders, vertical-joint connections and the like, is no longer necessary. If required, during repairs to the roof at some later stage, the covering profiles can be removed and subsequently be replaced in position.

Particular forms of the preferred embodiment of the invention are further described below.

An embodiment of the invention to be discussed in greater details in what follows is depicted in the drawings, in which:

FIG. 1 is a covering affixed to the raised surrounding edge of a flat roof with two details shown on an enlarged scale;

FIGS. 1A and 1B are fragmentary perspective views of a holder and covering profile of the present invention respectively.

Figure 2:
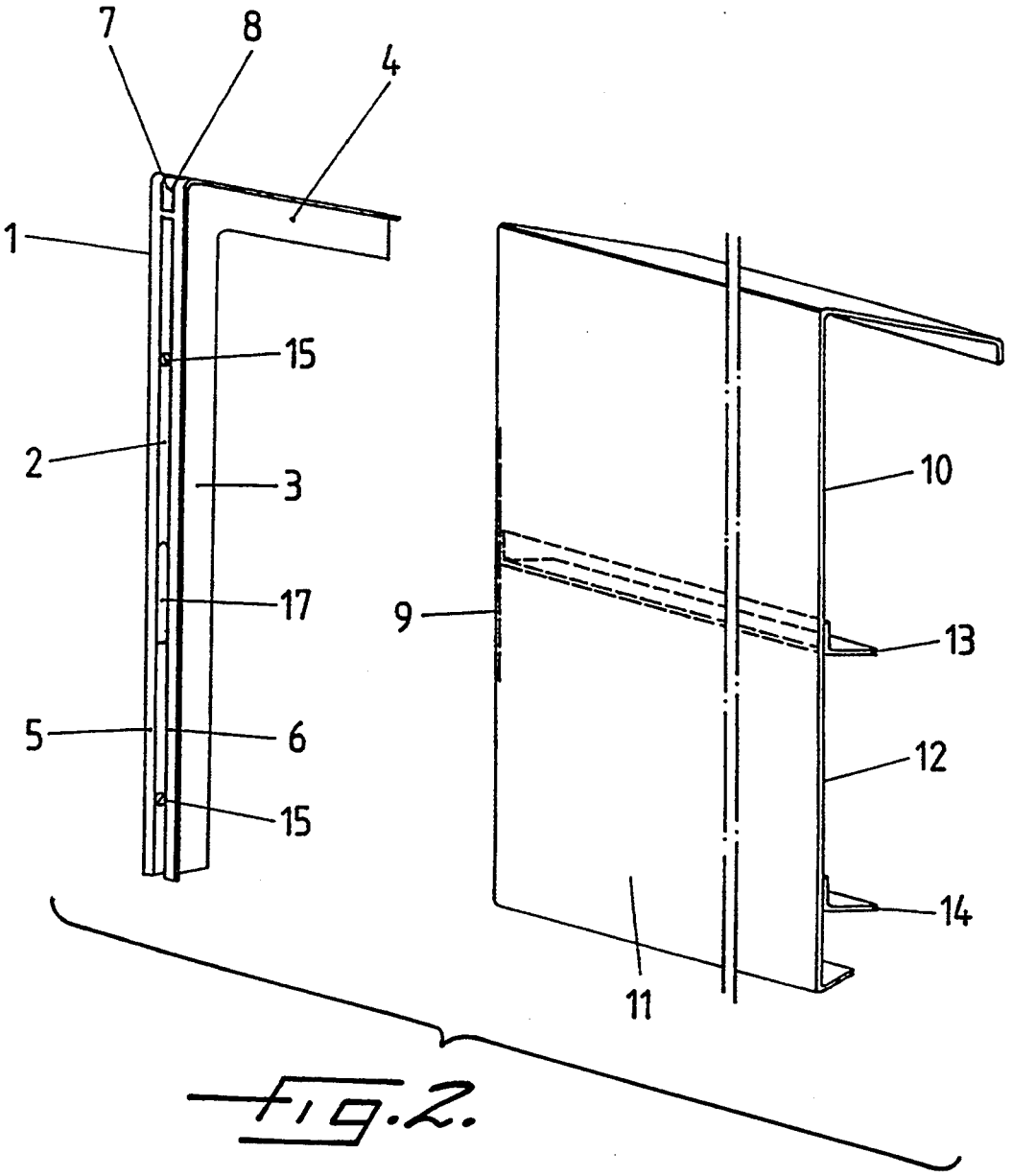
FIG. 2 is a holder and one end of a covering profile of the covering shown in FIG. 1.

The single-piece, angle-shaped holder 1 having a hat-like configuration possesses a recess 2 in both of its shanks 3 and 4, where It is affixed to the roof surround by means of the fastening means provided in said recess. With the use of the pressure screws 15, likewise disposed in this recess 2, the position of the holder 1 may be adjusted in relation to the outside surface of the wall of the building. Then, a covering profile 11, by way of example when working from the left-hand end towards the fight-hand end, is pushed into position with its end 9 behind the inner side 8 of the flange 6 of the holder 1. Following this, the next holder 1 is pushed onto the other end 10 of the covering profile 11 so that the inner side 7 of its flange 5 rests against the outer side of the covering profile 11, and then it is fastened to the roof surround and adjusted in position by means of the pressure screws 15 located in the recess 2. On the inner surface 12 of the covering profile 11 there are spacer profiles 13, 14 for holding it at a short distance away from the outer surface of the roof surround. After completion of the assembly, the recess Z is provided with a cover strip 17.

Specially fabricated comer-covering profiles are first mounted exactly vertically, and then the holders 1 referred to initially and the covering profiles 11 are mounted exactly vertically on the sides of said comer profiles. Proceeding along always towards the centre point of the roof surround, successive covering profiles 11 and holders 1 are simultaneously mounted, as previously described.

With the aid of the built-in pressure screws 15 in the holder 1, an exactly aligned covering for the raised surrounding edge of a roof may be achieved.

I claim:

1. In combination, a flat roof having a raised surrounding edge which includes an outer side and a top, and a covering attached to the raised surrounding edge so as to cover said outer side and said top of said raised surrounding edge, said covering comprising a plurality of elongate covering profiles, each of said covering profiles comprising a first panel having an inside surface, a second panel extending from the inside surface of said first panel when viewed in cross section, and at least one spacer profile fixed to the inside surface of said first panel, said covering profiles positioned in end to end relation along the raised surrounding edge with said first panel of each covering profile overlying the outer side of the surrounding edge and being held spaced therefrom by said one spacer profile, and with said second panel of each covering profile overlying the top of the surrounding edge, and a plurality of holders disposed respectively between adjacent ends of the adjacent cover profiles, each of said holders having a generally L-shaped configuration so as to define a first leg in the direction of said first panel and a second leg in the direction of said second panel, each of said holders further having a generally hat-shaped cross section defining a U-shaped recess and a pair of oppositely directed flanges such that the flanges overlap the ends of said first panels and the ends of said second panels of the adjacent covering profiles, and means securing each of said holders to the raised surrounding edge to thereby retain the covering profiles against the surrounding edge.

2. The combination as defined in claim 1 wherein said second panel of each of said covering profiles extends from the associated inside surface of said first panel at an acute angle.

3. The combination as defined in claim 1 wherein said securing means comprises a plurality of screws extending through respective apertures in the U-shaped recess of each of said holders.

4. The combination as defined in claim 1 wherein each of said holders further comprises an external cover strip overlying the associated U-shaped recess.

* * * * *